US009000743B2

(12) United States Patent
Ting

(10) Patent No.: US 9,000,743 B2
(45) Date of Patent: Apr. 7, 2015

(54) MULTI-CHANNEL CONSTANT VOLTAGE AND CONSTANT CURRENT CONVERTING CONTROLLER AND APPARATUS

(71) Applicant: Analog Vision Technology Inc., New Taipei (TW)

(72) Inventor: Ming-Chiang Ting, Hsinchu (TW)

(73) Assignee: Green Solution Technology Co., Ltd., Taipei County (TW)

( * ) Notice: Subject to any disclaimer, the term of this patent is extended or adjusted under 35 U.S.C. 154(b) by 428 days.

(21) Appl. No.: 13/645,419

(22) Filed: Oct. 4, 2012

(65) Prior Publication Data

US 2013/0328532 A1 Dec. 12, 2013

(30) Foreign Application Priority Data

Jun. 6, 2012 (TW) ..... 101120289 A

(51) Int. Cl.

| | |
|---|---|
| ***G05F 1/56*** | (2006.01) |
| ***G05F 1/565*** | (2006.01) |
| *G05F 1/577* | (2006.01) |
| *G05F 1/569* | (2006.01) |
| *G05F 1/575* | (2006.01) |

(52) U.S. Cl.

CPC . *G05F 1/56* (2013.01); *G05F 1/577* (2013.01); *G05F 1/569* (2013.01); *G05F 1/575* (2013.01); *G05F 1/565* (2013.01)

(58) Field of Classification Search

USPC ..... 323/267, 273–281

See application file for complete search history.

(56) References Cited

U.S. PATENT DOCUMENTS

| | | | | |
|---|---|---|---|---|
| 6,891,736 | B2 * | 5/2005 | Takemura et al. | 363/65 |
| 6,977,489 | B2 * | 12/2005 | Isham | 323/272 |
| 8,148,911 | B2 * | 4/2012 | Chen et al. | 315/250 |
| 8,587,346 | B2 * | 11/2013 | Kamatani | 327/108 |
| 2009/0058377 | A1 | 3/2009 | Ting | |
| 2009/0187925 | A1 * | 7/2009 | Hu et al. | 719/327 |
| 2014/0210359 | A1 * | 7/2014 | Raval et al. | 315/186 |

FOREIGN PATENT DOCUMENTS

| | | | |
|---|---|---|---|
| CN | 1783681 | A | 6/2006 |
| CN | 101026316 | A | 8/2007 |
| CN | 101393464 | A | 3/2009 |
| CN | 101847025 | A | 9/2010 |
| CN | 101847929 | A | 9/2010 |
| TW | 201212713 | A1 | 3/2012 |
| TW | I395080 | B1 | 5/2013 |
| WO | WO2009064682 | A2 | 5/2009 |

* cited by examiner

*Primary Examiner* — Jessica Han

(74) *Attorney, Agent, or Firm* — Li&Cai Intellectual Property (USA) Office

(57) ABSTRACT

A multi-channel constant voltage and constant current converting controller is provided. It comprises a multi-channel balance circuit and an error amplifier circuit. The multi-channel balance circuit receives a first voltage signal and load current detecting signals and outputs a second voltage signal and amplifying load current detecting signals. The error amplifier circuit receives the second voltage signal, the amplifying load current detecting signals and a reference voltage and outputs an error amplifying signal. The error amplifier circuit outs the error amplifying signal according to the reference voltage and the maximum value between the second voltage signal and amplifying load current detecting signals.

10 Claims, 4 Drawing Sheets

MULTI-CHANNEL CONSTANT VOLTAGE AND CONSTANT CURRENT CONVERTING CONTROLLER AND APPARATUS

BACKGROUND

1. Technical Field

The present disclosure relates to a power converting controller circuit; in particular, to a multi-channel constant voltage and constant current converting controller and apparatus thereof.

2. Description of Related Art

A constant voltage and constant current converting control is usually applied to the charging module of the lithium battery and current-limiting and voltage-regulating module, etc.

The charging module of the lithium battery utilizes the constant current mode to rapidly charge the lithium battery in the constant current control period. As the lithium battery already gets enough power, the power source doesn't stop supplying the power to it. If the power source still supplies power to the lithium battery, the lifetime of the lithium battery may be decreased for the overcharge thereof. Hence, the constant current and the constant voltage controller may be utilized to switch the charging module of the lithium battery to constant voltage mode as the voltage level of the lithium battery reaching a predetermined protected value for clamping the voltage level of the lithium battery. Thereby, the lithium battery is protected and completely charged.

The current-limiting and the voltage-regulating module utilizes the constant mode to control the voltage of the output load. As the current of the output load reaches a predetermined protected value, the current-limiting and the voltage-regulating module is switched to constant current mode to clamp the current of output load for accomplishing the current-limiting protection purpose for the output load. For the example, as the LED string is driven by constant voltage mode and one of the LED in it is broken, the current through LED string increases. It may cause the other LEDs be damaged. To avoid above-mentioned issue, the constant voltage and constant current inverting control can be utilized in the LED string. As the current through the LED string reached a predetermined protection value, the current-limiting and the voltage-regulating module is switched to constant current mode for clamping the current and keeping the wanted luminance and then protects LEDs.

The constant voltage and constant current inverting control is generally applied in the life. The design of constant voltage and constant current inverting control with multi-channel is the develop direction in the current electric community. The design of the multi-channel constant voltage and constant current inverting control is needed to consider the relation of the inverting point of constant voltage and constant current between each channel and it is complex. The wire loss of each channel is also need to consider in the multi-channel design of the constant voltage and constant current inverting control. Therefore, how to compensate the wire loss between each channel and make output voltage fit the electrical specification is an important topic of the skilled art.

SUMMARY

Accordingly, the present invention provides a multi-channel constant voltage and constant current converting controller which uses a multi-channel balance circuit to detect the load current detecting signals of each channels. When some channel is changed to a constant current protection mode, the other channels would be changed to constant current protection mode. The present invention also provides compensation function for the line loss between the channels. A property compensation voltage value is selected to balance the voltage of the line loss between the channels for fitting the output voltage to the electrical specification and implements the purpose of controlling the multi-channel constant voltage and constant current converting.

For implementing the aforesaid purpose, the present disclosures a multi-channel constant voltage and constant current converting controller. The multi-channel constant voltage and constant current converting controller comprises a multi-channel balance circuit and an error amplifier circuit. The multi-channel balance circuit receives a first voltage signal and a plurality of load current detecting signals and outputs a second voltage signal and a plurality of amplified load current detecting signals. The error amplifier circuit receives the second voltage signal, the amplified load current detecting signals and a reference voltage and outputs an error amplifier signal. Wherein, the error amplifier circuit outputs the error amplifier signal according to the second voltage signal, the maximum voltage value of the amplified load current detecting signals and the reference voltage.

Accordingly, the present disclosure also provides a multi-channel constant voltage and constant current converting control apparatus which comprises a power control circuit, a power stage, a voltage detecting circuit, load current detecting circuits and a multi-channel constant voltage and constant current converting controller.

The power control circuit transforms the input voltage to a power output. The power stage receives the power output and transforms it to a voltage signal for a load. The voltage detecting circuit detects the voltage signal and outputs a first voltage signal. The current detecting circuit detects the current through the corresponding load and outputs a plurality of load current detecting signals. The multi-channel constant voltage and constant current converting controller comprises a multi-channel balance circuit and an error amplifier circuit. The multi-channel balance circuit receives the first voltage signal and a plurality of the load current detecting signals and outputs a second voltage signal and a plurality of amplified load current detecting signals. The error amplifier circuit receives the second voltage signal, the amplified load current detecting signals and a reference voltage and outputs an error amplifier signal. Wherein, the error amplifier circuit outputs the error amplifier signal according to the second voltage signal, a maximum voltage value of the amplified load current detecting signals, and the reference voltage.

In order to further appreciate the characteristic and technical contents of the instant disclosure, references are hereunder made to the detailed descriptions and appended drawings in connection with the instant disclosure. However, the appended drawings are merely shown for exemplary purpose rather being used to restrict the scope of the instant disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1A:
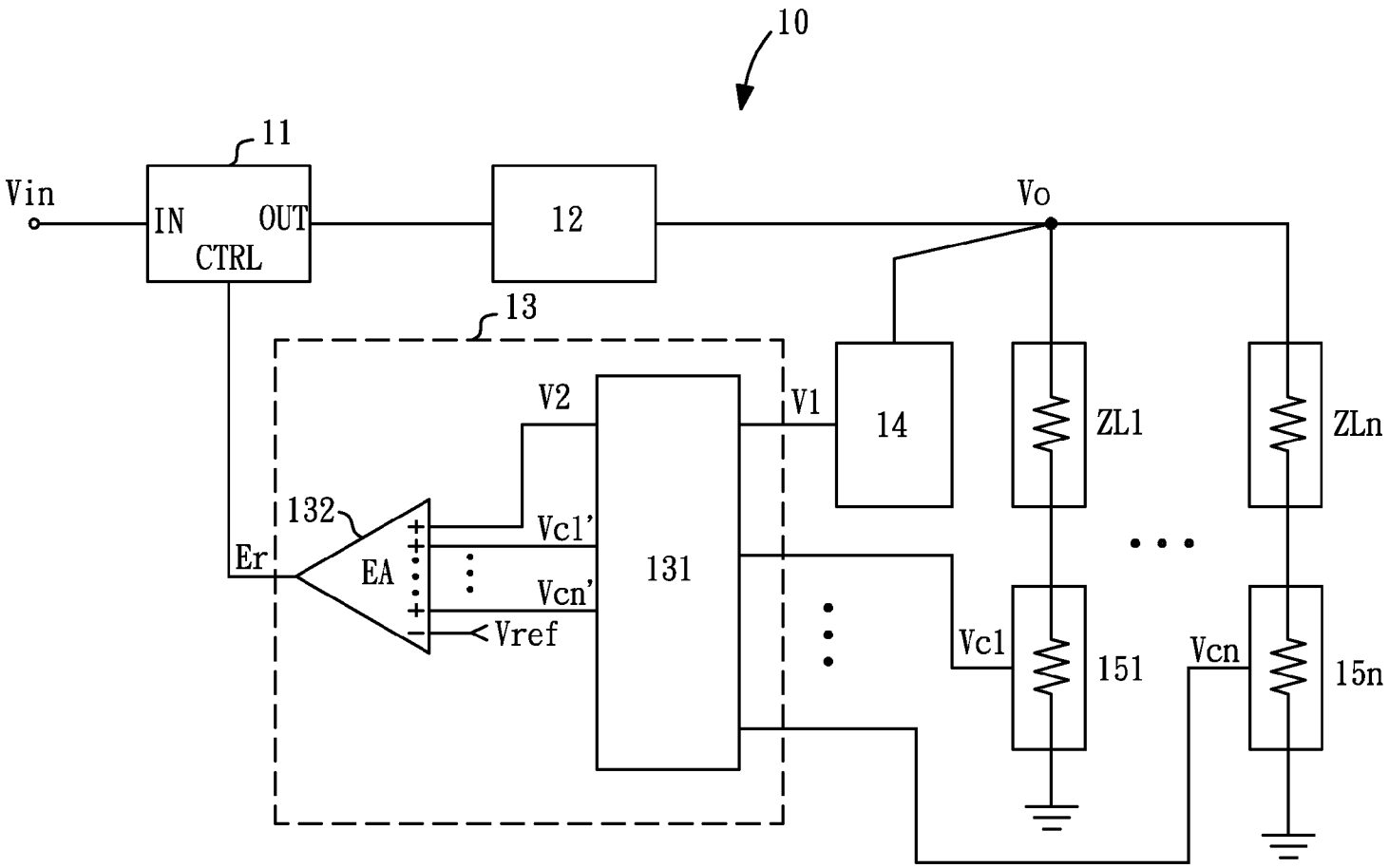
FIG. 1A shows a circuit diagram of the multi-channel constant voltage and constant current converting control apparatus according to an embodiment of the present invention.

FIG. 1A shows a circuit diagram of the multi-channel constant voltage and constant current converting control apparatus according to an embodiment of the present invention. As shown in the FIG. 1A, the multi-channel constant voltage and constant current converting control apparatus comprises a power control circuit 11, a power stage 12, an multi-channel constant voltage and constant current converting controller 13, a voltage detecting circuit 14 and a plurality of load current detecting circuits 151~15*n*.

The power control circuit 11 is controlled by an error amplifier signal Er to transform an input voltage Vin to the power supplying for the multi-channel constant voltage and constant current converting control apparatus 10 and outputs it to power stage 12. The power stage 12 outputs a voltage signal Vo for loads ZL1~ZLn according to the output signal of the power control circuit 11. The power stage 12 may be a boost circuit or a buck circuit, but the present invention is not limited thereto.

The voltage detecting circuit 14 detects the voltage signal Vo and outputs a first voltage signal V1. The multi-channel constant voltage and constant current converting controller 13 receives a first voltage signal V1 and a plurality of load current detecting signals Vc1~Vcn and outputs the error amplifier signal Er to control the power control circuit 11. The load current detecting signals Vc1~Vcn are the voltage signals produced by the load current detecting circuits 151~15*n* detecting the current of the loads ZL1~ZLn. The load current detecting circuits 151~15*n* usually utilize resistor dividing voltage method to detect the load current detecting signals Vc1~Vcn.

Figure 1B:
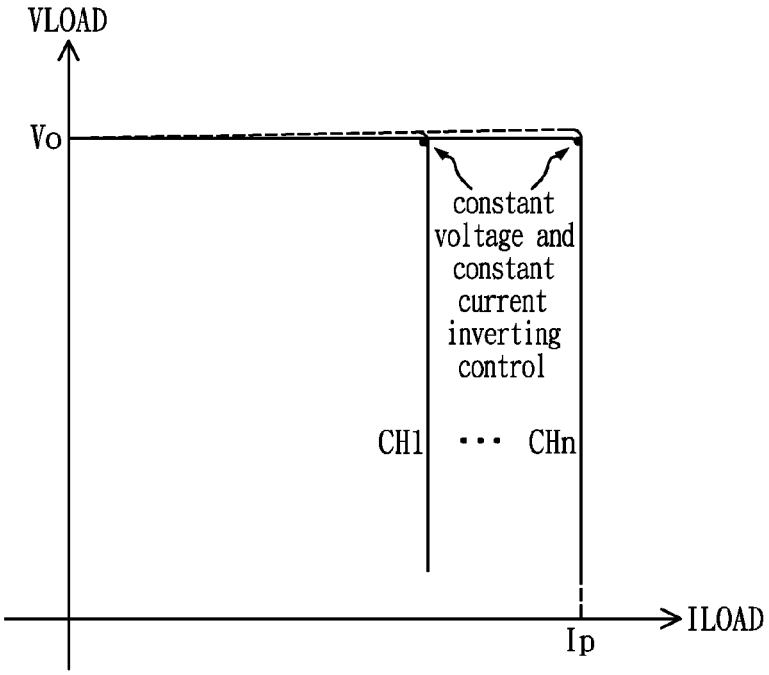
FIG. 1B is the voltage and current converting relationship diagram of the multi-channel constant voltage and constant current converting control apparatus according to the embodiment in the FIG. 1A.

The multi-channel constant voltage and constant current converting controller 13 comprises a multi-channel balance circuit 131 and an error amplifier circuit 132. The multi-channel balance circuit 131 receives the first voltage signal V1 and a plurality of the load current detecting signals Vc1~Vcn and outputs a second voltage signal V2 and a plurality of amplified load current detecting signals Vc1'~Ycn'. The error amplifier circuit 132 outputs the error amplifier signal Er according to the second voltage signal V2, a maximum voltage value Vci of the amplified load current detecting signals Vc1'~Ycn' and the reference voltage Vref Please refer to FIG. 1B in conjunction with FIG. 1A. FIG. 1B is the voltage and current converting relationship diagram of the multi-channel constant voltage and constant current converting control apparatus according to the embodiment in the FIG. 1A. As the second voltage signal V2 is bigger than the amplified load current detecting signals Vc1'~Vcn', the error amplifier circuit 132 outputs the error amplifier signal Er according to the second voltage signal V2 and the reference voltage Vref to control the power control circuit 11. At this time, the multi-channel constant voltage and constant current inverting control apparatus is a constant voltage mode. As the second voltage signal V2 is smaller than the maximum voltage value Vci of the amplified load current detecting signals Vc1'~Vcn', the error amplifier circuit 132 outputs the error amplifier signal Er according to the maximum voltage value Vci of the amplified load current detecting signals Vc1'~Vcn' and the reference voltage Vref to control the power control circuit 11. Then, the multi-channel constant voltage and constant current inverting control apparatus is converted to a constant current mode from the constant voltage mode.

The multi-channel is as shown in the FIG. 1B. As one of the channel CHn reaches a predetermined current value Ip, the constant voltage and constant current converting controller 13 outputs the error amplifier signal Er to control the power control circuit 11 and converts the channel CHn to a constant current mode from a constant voltage mode. At the same time, the other channels CH1~CH(n−1) are converted to the constant current mode from the constant voltage mode.

In the actual application, the existence of the wire loss may cause the voltage may not keep a constant value in the constant voltage mode. The voltage may rise with the increase of the current (shown as the dotted line in the FIG. 1B) to cause the increase in the inaccuracy of the feedback control and the influence in the output stability of the constant voltage and constant current converting controller 13. For compensating the above-mentioned inaccuracy, the multi-channel constant voltage and constant current inverting control apparatus 10 according to the amplified load current detecting signals Vc1'~Vcn' and a first voltage signal V1 to produce the second voltage signal V2. After being compensated, the voltage and current converting relationship is as solid line.

Figure 2:
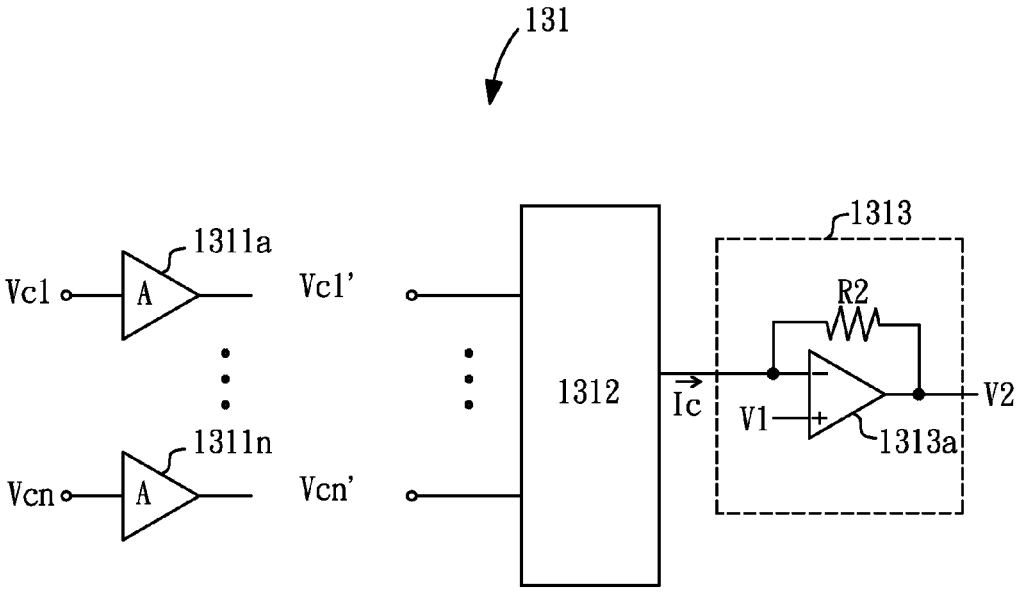
FIG. 2 shows a circuit diagram of the multi-channel balance circuit 131 in the FIG. 1A according to an embodiment of the present invention.

FIG. 2 shows a circuit diagram of the multi-channel balance circuit 131 in the FIG. 1A according to an embodiment of the present invention. The multi-channel balance circuit 131 comprises a plurality of amplifiers 1311*a*~1311*n*, a current level translator 1312 and a compensating circuit 1313. The amplifiers 1311*a*~1311*n* are configured to the same amplification factor A, which may amplify the load current detecting signals Vc1~Vcn and output the amplified load current detecting signals Vc1'~Vcn'. The current level translator 1312 detects the amplified load current detecting signals Vc1'~Vcn' and according to the maximum voltage value Vci of the amplified load current detecting signals Vc1'~Vcn' to output a corresponding compared current signal Ic. The amplifier 1311*a*~1311*n* is utilized to amplify the amplified load current detecting signals Vc1~Vcn and it would advantage the current level translator 1312 to determine these signal. If the current level translator 1312 would determine the load current detecting signals Vc1~Vcn, the amplifiers 1311*a*~1311*n* could be omitted.

The compensating circuit 1313 outputs the second voltage signal V2 according to the compared current signal Ic and the first voltage signal V1. The compensating circuit 1313 comprises a compensating amplifier 1313*a* and resistor R2. The resistor R2 is coupled to the output end and the inverting input end of the compensating amplifier 1313*a*. The second voltage signal V2 may be represented as the following function (1):

$$V2=V1-Ic*R2 \qquad \text{function (1)}$$

V2 is the second voltage signal, V1 is the first voltage signal, R2 is the resistor, Ic is the compared current signal.

Figure 3:
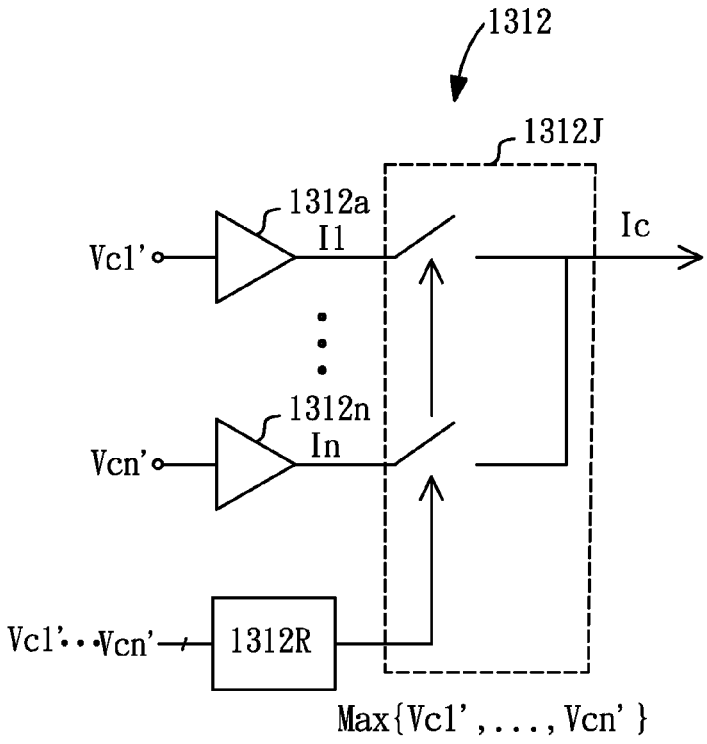
FIG. 3 shows circuit diagram of the current level translator 1312 in the FIG. 2 according to an embodiment of the present invention.

FIG. 3 shows circuit diagram of the current level translator 1312 in the FIG. 2 according to an embodiment of the present invention. The current level translator 1312 comprises a plurality of current translating units 1312*a*~1312*n*, a comparator 1312R and a selector 1312J. The current translating units 1312*a*~1312*n* respectively receive the corresponding amplified load current detecting signals Vc1'~Vcn', and output the corresponding unit current I1~In. The comparator 1312R receives the amplified load current detecting signals Vc1'~Vcn' and compare these signals. Then, the comparator 1312R outputs the maximum voltage value (Max{Vc1', . . . , Vcn'}) of these signals. The selector 1312J outputs the corresponding current according to the maximum voltage value (Max{Vc1', . . . , Vcn'}) of the amplified load current detecting signals Vc1'~Vcn'. The current is the compared current signal Ic. For example, if the maximum voltage value of the amplified load current detecting signals Vc1'~Vcn' is Vc1', the selector 1312J selects the unit current I1 as the output current of the current level translator 1312. The output current is as the compared current signal Ic.

Figure 4:
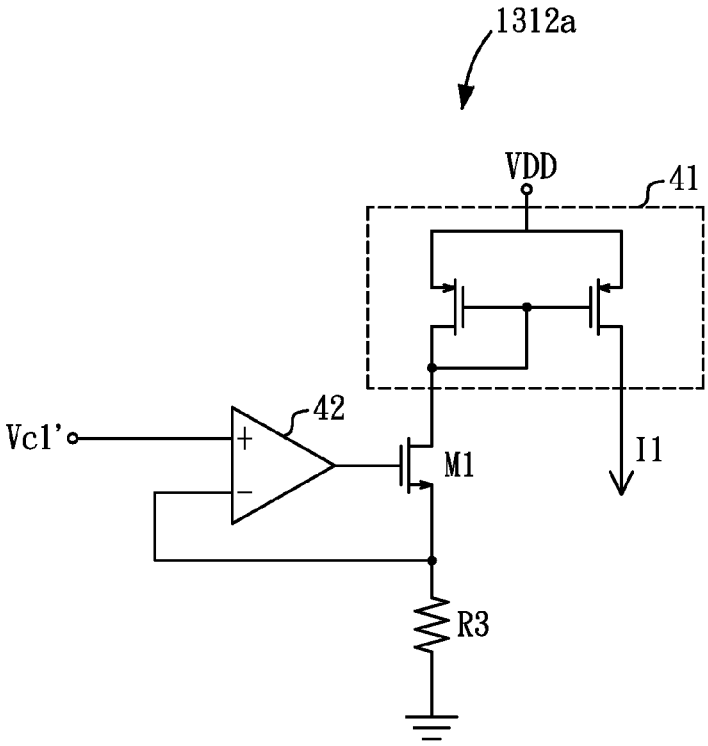
FIG. 4 shows the circuit diagram of the current translating unit 1312*a* in the FIG. 3 according to an embodiment of the present invention.

FIG. 4 shows the circuit diagram of the current translating unit 1312*a* in the FIG. 3 according to an embodiment of the present invention. The current translating unit 1312*a* comprises a current mirror 41, a transistor M1 and a comparator 42. The non-inverting input end of the comparator 42 receives the amplified load current detecting signal Vc1'. The inverting end of the comparator 42 is coupled to the source of the transistor M1 and a resistor R3. The output end of the comparator 42 is coupled to the gate of the transistor M1. The drain of the transistor M1 is coupled to a output end of the current mirror 41 and the other output end of the current mirror 41 output unit current I1. The value of the unit current I1 is defined by the voltage value of the amplified load current detecting signal Vc1' and the resistance of the resistor R3.

Figure 5:
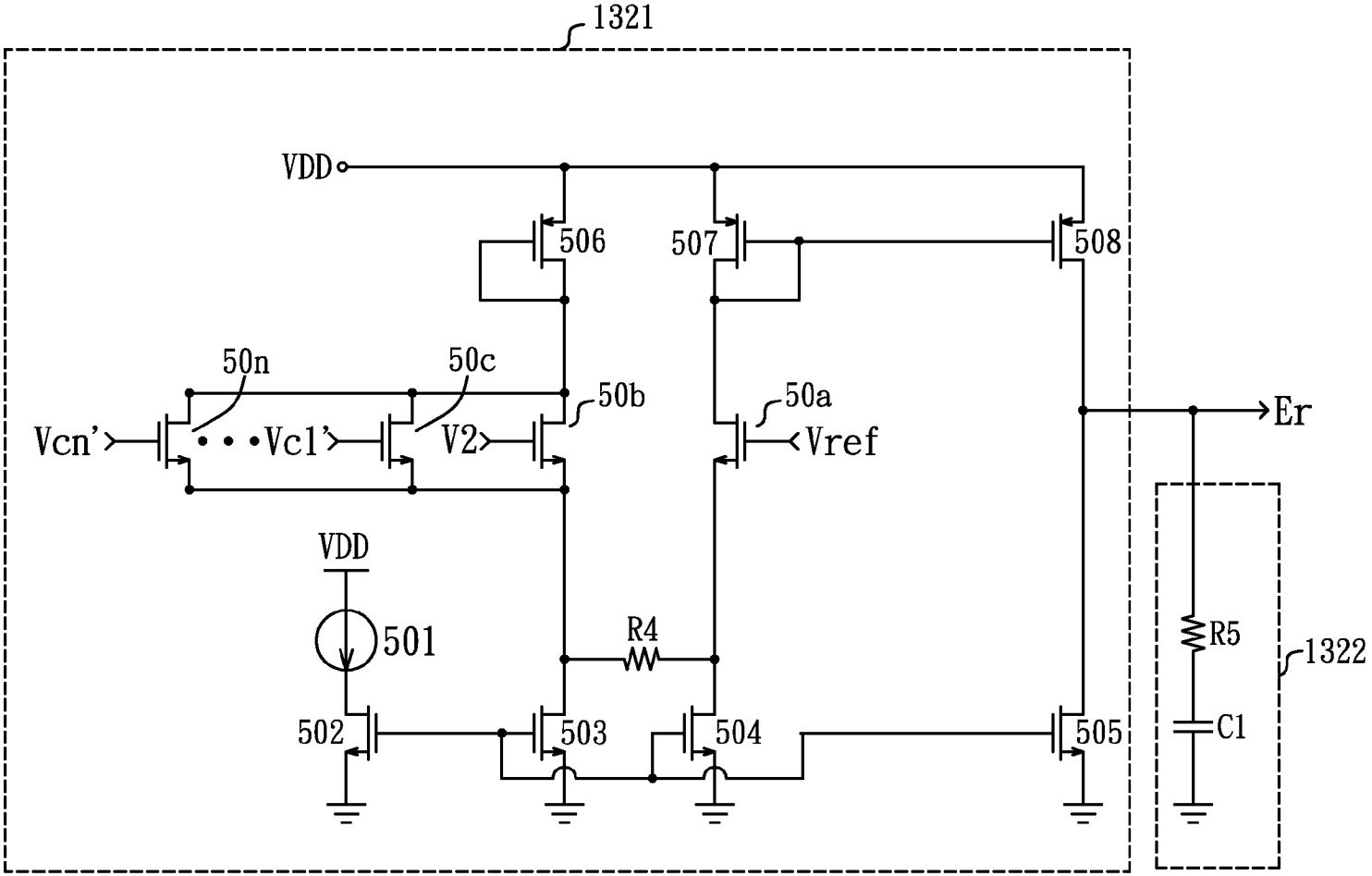
FIG. 5 shows the circuit diagrams of the error amplifier circuit 132 in FIG. 1A according to an embodiment of the present invention.

FIG. 5 shows the circuit diagrams of the error amplifier circuit 132 in FIG. 1A according to an embodiment of the present invention. The error amplifier circuit 132 comprises a transconductance amplifier 1321 and a compensating load 1322. The transconductance amplifier 1321 is composed of differential amplifying pair with transistor 50*a* 、 50*b* 、 50*c*~50*n* 、 transconductance source with resistor R4 、 reference current source 501 、 bias current source with transistor 502 、 503 、 504 、 505 and active loading with transistor 506 、 507. The transistor 507 is utilized to transmit the differential current which is generated by the differential amplifying pair (i.e. the transistor 50*a* 、 50*b* 、 50*c*~50*n*) comparing the reference voltage Vref and the second voltage signal V2 and a plurality of the amplified load current detecting signals Vc1'~Vcn' and via the resistor R4. The transistor 506 is a symmetrical load to implement symmetrical differential amplification. The transistors 508 and 507 form a current mirror for outputting the current. The output current value of the transconductance amplifier 1321 is determined by the bias current source of the transistor 505. The compensating load 132 comprises the load resistor R2 and the compensating capacitor C1 and receives the output current value of the transconductance amplifier 1321 for implementing the error amplifier signal Er which is outputted from the error amplifier circuit 132. At the same time, the loop compensation of the power converting module is implemented.

The above-mentioned is only the embodiment of the present invention, which can't be used to restrict the scope of the present invention.

What is claimed is:

1. A multi-channel constant voltage and constant current converting controller, comprising:

a multi-channel balance circuit for receiving a first voltage signal and a plurality of load current detecting signals and outputting a second voltage signal and a plurality of amplified load current detecting signals; and an error amplifier circuit for receiving the second voltage signal, the amplified load current detecting signals and a reference voltage, and outputting an error amplifier signal;

wherein the error amplifier circuit outputs the error amplifier signal according to the second voltage signal, a maximum voltage value of the amplified load current detecting signals, and the reference voltage.

2. The multi-channel constant voltage and constant current converting controller of claim 1, wherein as the second voltage signal is bigger than the amplified load current detecting signals, the error amplifier circuit outputs the error amplifier signal according to the second voltage signal and the reference voltage.

3. The multi-channel constant voltage and constant current converting controller of claim 1, wherein as the maximum voltage value of the amplified load current detecting signals is bigger than the second voltage signal, the error amplifier circuit outputs the error amplifier signal according to the maximum voltage value of the load current detecting signals and the reference voltage.

4. The multi-channel constant voltage and constant current converting controller of claim 1, wherein the multi-channel balance circuit comprises a current level translator, which outputs a compared current signal according to the maximum voltage value of the amplified load current detecting signals.

5. The multi-channel constant voltage and constant current converting controller of claim 4, wherein the multi-channel balance circuit comprises a compensating circuit, which receives the compared current signal and the first voltage signal and outputs the second voltage signal.

6. The multi-channel constant voltage and constant current converting controller of claim 4, wherein the current level translator comprises:

a plurality of current translating units, wherein each the current translating unit respectively receives one of the amplified load current detecting signals and outputs a unit current;

a comparator, which receives the load current detecting signals and outputs the maximum voltage value; and a selector, according to the maximum voltage value to select to output the corresponding unit current.

7. The multi-channel constant voltage and constant current converting controller of claim 1, wherein the multi-channel balance circuit comprises a plurality of amplifiers with the same amplification factor for receiving the load current detecting signals and outputs the amplified load current detecting signals.

8. The multi-channel constant voltage and constant current converting controller of claim 1, further comprising a voltage detecting circuit for detecting the output signal of a power stage and outputting the first voltage signal.

9. A multi-channel constant voltage and constant current converting control apparatus, comprising:

a power control circuit for transforming the input voltage to a power output;

a power stage for receiving the power output and transforming the power output to a voltage signal for a load;

a voltage detecting circuit for detecting the voltage signal and outputting a first voltage signal;

a plurality of load current detecting circuits for detecting the current through the corresponding load and outputting a plurality of load current detecting signals; and a multi-channel constant voltage and constant current converting controller, comprising:

an multi-channel balance circuit for receiving the first voltage signal and a plurality of the load current detecting signals and outputting a second voltage signal and a plurality of amplified load current detecting signals; and an error amplifier circuit for receiving the second voltage signal, the amplified load current detecting signals and a reference voltage, and outputting an error amplifier signal;

wherein, the error amplifier circuit outputs the error amplifier signal according to the second voltage signal, a maximum voltage value of the amplified load current detecting signals, and the reference voltage.

10. The multi-channel constant voltage and constant current converting control apparatus of claim 9, wherein as the second voltage signal is bigger than the amplified load current detecting signals, the error amplifier circuit outputs the error amplifier signal according to the second voltage signal and the reference voltage to control the power control circuit; as a maximum voltage value of the amplified load current detecting signal is bigger than the second voltage signal, the error amplifier circuit outputs the error amplifier signal according to the maximum voltage value of the amplified load current detecting signals and the reference voltage to control the power control circuit.

* * * * *